US006075445A

United States Patent [19]

McLoughlin et al.

[11] Patent Number: 6,075,445

[45] Date of Patent: Jun. 13, 2000

[54] HIGH-TEMPERATURE WARNING UNIT

[76] Inventors: John E. McLoughlin, 26 Southern Blvd., Nesconset, N.Y. 11767; Neocles G. Athanasiades, 6 Maybeck Dr., East Setauket, N.Y. 11733; Kiam Meng Toh, 15 Sunflower Dr., Hauppague, N.Y. 11788; Joseph Raymond Paris, Three Riviera Dr., Massapequa, N.Y. 11758-8509

[21] Appl. No.: 09/335,540

[22] Filed: Jun. 18, 1999

Related U.S. Application Data

[60] Provisional application No. 60/089,934, Jun. 19, 1998.

[51] Int. Cl.[7] ..... G08B 17/00

[52] U.S. Cl. ..... 340/586; 340/584; 340/573; 340/590; 340/578

[58] Field of Search ..... 340/584, 586, 340/578, 573, 590, 691, 32, 331, 537

[56] References Cited

U.S. PATENT DOCUMENTS 3,201,771 8/1965 Proulx ..... 340/227

3,927,571 12/1975 Athey ..... 340/228

5,200,736 4/1993 Coombs et al. ..... 340/586

5,329,637 7/1994 Walker ..... 340/573

5,570,077 10/1996 Swieboda ..... 340/331

*Primary Examiner*—Jeffrey A. Hofsass

*Assistant Examiner*—Hung Nguyen

*Attorney, Agent, or Firm*—Louise S. Heim

[57] ABSTRACT

A high-temperature warning indicator is provided for attachment to a firefighter's helmet. In a preferred embodiment of the invention, the indicator is in the form of a dual-color LED mounted in the tip of a highly insulated, lightweight housing. A microprocessor located within the housing and coupled to a temperature sensor activates the light, changes it from solid to flashing modes, and changes the color of the light as various temperature/time thresholds are reached. A clamp or similar mounting device is provided for securing the device to the brim of the firefighter's helmet.

10 Claims, 4 Drawing Sheets

FIG. 1
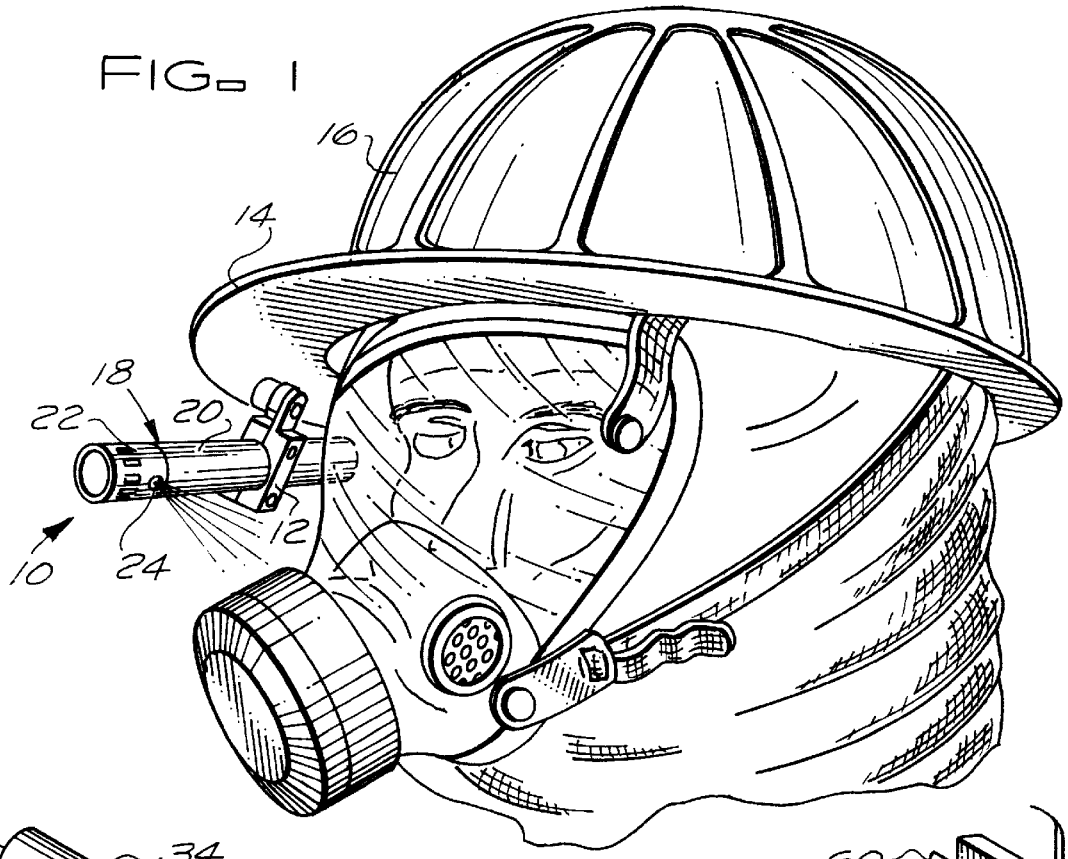
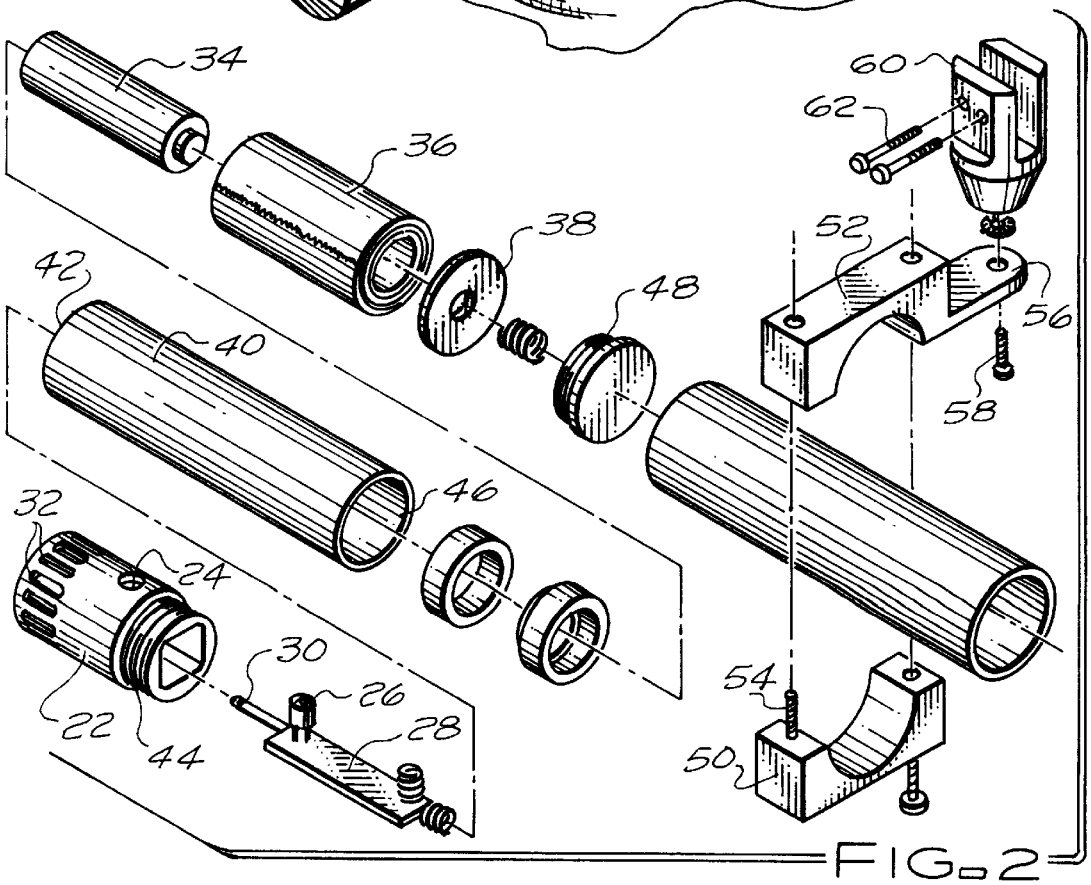
FIG. 2

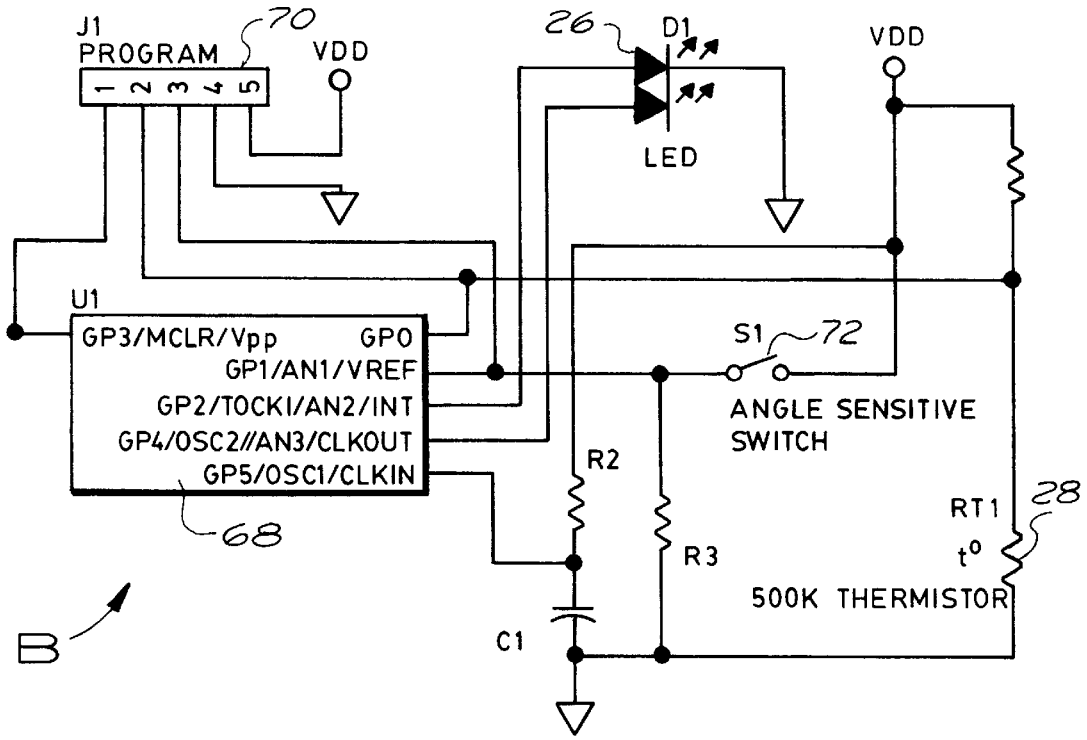
J1
PROGRAM
70
VDD
1 2 3 4 5
26
D1
LED
VDD
U1
GP3/MCLR/Vpp
GP0
GP1/AN1/VREF
GP2/TOCKI/AN2/INT
GP4/OSC2//AN3/CLKOUT
GP5/OSC1/CLKIN
68
S1
72
ANGLE SENSITIVE
SWITCH
R2
R3
RT1
28
t°
500K THERMISTOR
C1
B
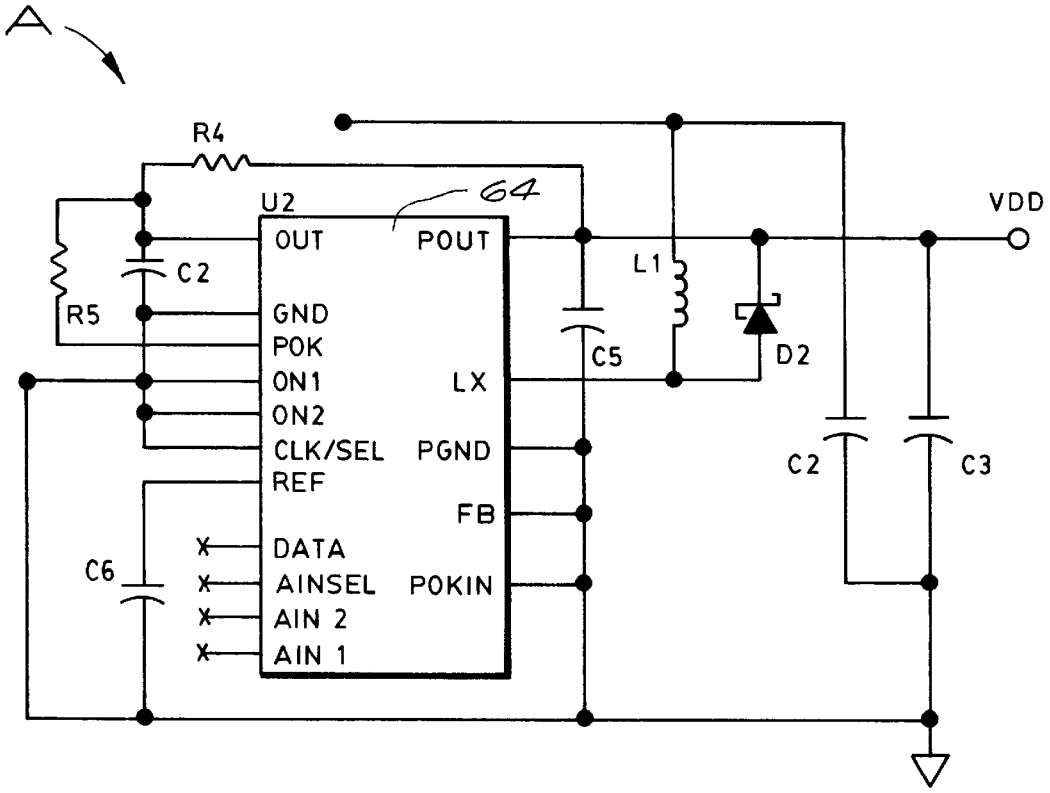
A
R4
U2
64
OUT
POUT
VDD
C2
R5
GND
POK
ON1
ON2
CLK/SEL
REF
LX
PGND
FB
DATA
AINSEL
AIN 2
AIN 1
POKIN
L1
C5
D2
C2
C3
C6

HIGH-TEMPERATURE WARNING UNIT

REFERENCE TO RELATED APPLICATIONS

This application claims the benefit of U.S. Provisional Application No. 60/089934, filed Jun. 19, 1998.

BACKGROUND

1. Field of the Invention

This invention relates to the art of firefighting equipment.

More particularly, the invention relates to a unit for warning firefighters of dangerously high ambient temperatures.

In a further and more specific aspect, the invention concerns a high-temperature warning indicator for securing to a firefighter's helmet.

2. Description of the Prior Art

Firefighting apparel has become more and more heat-resistant over the years, and regulations regarding this apparel have become more stringent, with the intention of protecting firefighters from exposure to excessively high temperatures. One recently enacted law, for instance, requires that all firefighters wear hoods to protect the back of their necks from high heat. An unintended consequence of this law is that with absolutely no skin exposed to ambient conditions, firefighters have no way of knowing when the surrounding temperature has reached unsafe levels. Thus, they are in danger of staying in an area too long at temperatures which may exceed the range for which their equipment was designed, putting their lives in unreasonable peril. Even if they manage to leave the high temperature area without incurring any burns or other heat-related injuries, they could be unaware that the exterior surfaces of their garments are searing hot, and could burn themselves in the process of removing these garments.

Accordingly, a need exists for an apparatus for alerting firefighters of excessively high ambient temperatures.

SUMMARY OF THE INVENTION

Briefly, to achieve the desired objects of the instant invention in accordance with the preferred embodiments thereof, a high-temperature warning indicator is provided for attachment to a firefighter's helmet. In a preferred embodiment of the invention, the indicator is in the form of a dual-color LED mounted in the tip of a highly insulated, lightweight housing. A microprocessor located within the housing and coupled to a temmperature sensor activates the light, changes it from solid to flashing modes, and changes the color of the light as various temperature/time thresholds are reached. Mounting means such as a clamp are provided for securing the device to the brim of the firefighter's helmet.

BRIEF DESCRIPTION OF THE DRAWINGS

The foregoing and further and more specific objects and advantages of the instant invention will become readily apparent to those skilled in the art from the following detailed description of the preferred embodiments thereof taken in conjunction with the drawings in which:

FIG. 1 is a perspective view showing the high-temperature warning unit of the present invention attached to a firefighter's helmet.

FIG. 2 is a perspective view showing the elements of the high-temperature warning unit in exploded relationship to one another.

FIG. 3 is a circuit diagram showing the control circuit for the high-temperature warning unit.

DETAILED DESCRIPTION OF THE PREFERRED EMBODIMENT

Figure 4:
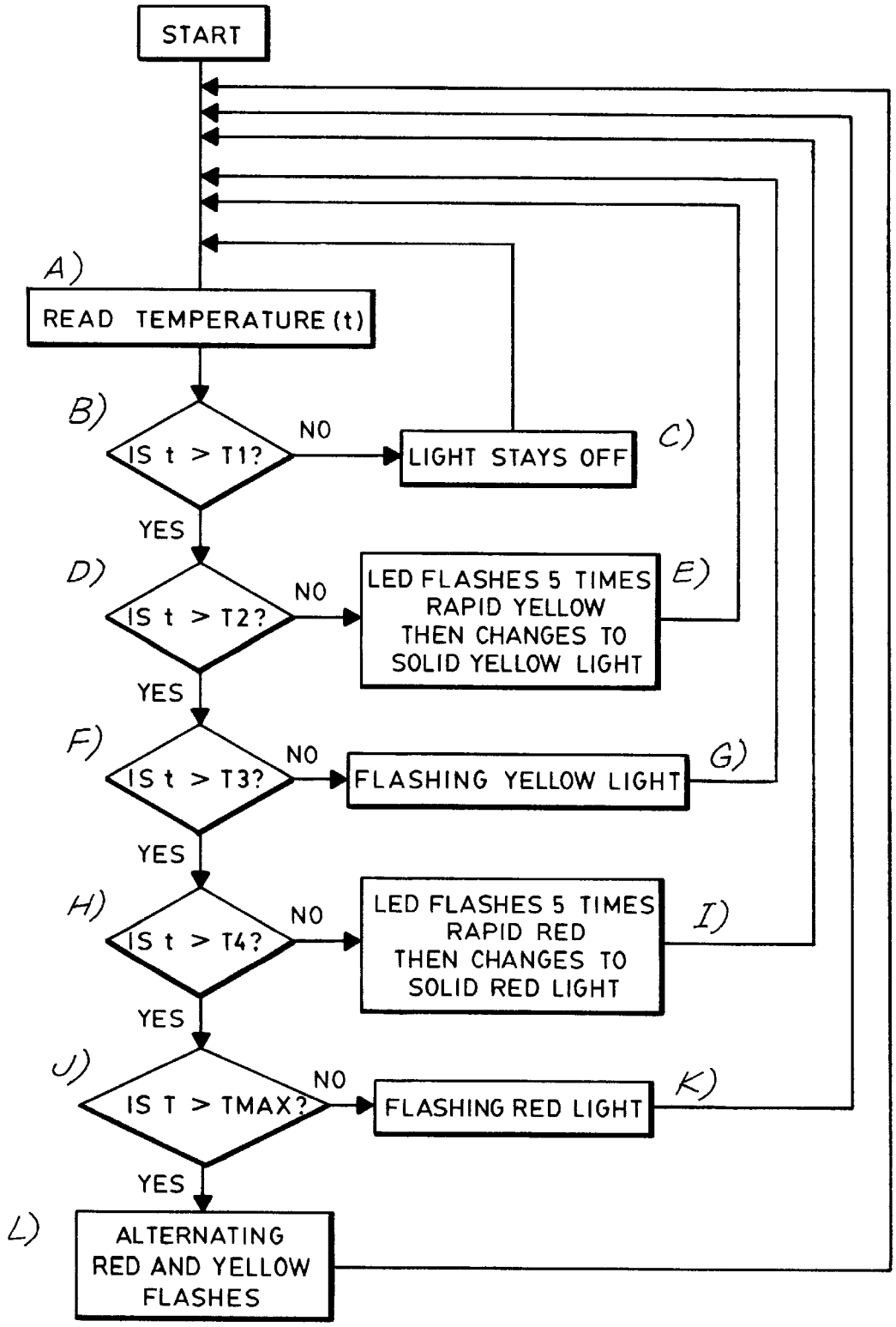
FIG. 4 is a simplified flow chart depicting the logic of the control circuit.

Turning now to the drawings in which like reference characters indicate corresponding elements throughout the several views, attention is first directed to FIG. 1, which shows the high-temperature warning unit 10 of the current invention secured by a clamp 12 to the brim 14 of a firefighter's helmet 16. The unit 10 is encased in a flame resistant outer cover 18 which includes a body portion 20, preferably formed of a tough aluminum, and a tip portion 22, preferably formed of a tough, high temperature composite material. A side opening 24 in the tip portion 22, located at a position which can be seen from a corner of the firefighter's eye when the device 10 is secured to the helmet 16 as shown, displays a visible signal when particular outside temperature/time levels are reached.

The visible signal is in the form of a light from a dual-color light emitting diode (LED) 26, which is shown in FIG. 2, along with the other elements of the unit 10. The LED 26 is mounted on a printed circuit board 28, which includes the control circuit for the unit, as will be described further in connection with FIG. 3. Also included on the printed circuit board 28 is a thermistor 30 which extends distally through the tip 22, and which communicates with the outside air via a series of vents 32 extending along the circumference of the tip 22.

The unit 10 is powered by a single "AA"-type battery 34 which is protected by a circumferentially extending insulator 36 and an insulating end disk 38. Still further protection from shock, water and heat is provided by a tubular battery housing 40, which is internally threaded at its distal end 42 to receive an externally threaded boss 44 on the proximal end of the tip 22, and at its proximal end 46 to receive a knurled end cap 48. A further layer of protection is added by the body portion 20 of the cover 18, which slides or is press fit over the battery housing 40.

The clamp 12 which secures the unit 10 to a firefighters helmet 16 includes a lower clamp portion 50 which encircles the lower portion of the cover 20 and an upper clamp portion 52 which encircles the upper portion of the cover 20. The lower and upper clamp portions 50 and 52 are detachably secured to one another by screws 54 or other conventional fasteners. An apertured flange 56 extending laterally from the upper clamp portion 52 receives another screw or similar fastener 58 which secures the clamp portions 50, 52 to a bifurcated helmet mount 60, the prongs of which receive the brim 14 of the helmet 16. The prongs are then secured to the brim 14 of the helmet 16 by fasteners such as screws 62 which extend through aligned holes drilled in the brim 14 and the prongs of the helmet mount 60.

The control circuit for the unit 10 is shown in FIG. 3. The control circuit consists of two functionally separate portions, A and B. Portion A is a DC to DC converter which converts the 1.5 volts of power supplied by the battery 34 to the 3.3 volts needed to power the components of portion B. Since the DC to DC converter of portion A is conventional, and can be constructed using a readily obtainable, off-the shelf integrated circuit (I.C.) chip 64 (such as MAX848), no further discussion of portion A is believed to be necessary. Portion B includes the thermistor 28, the output of which is input to a microprocessor 68 (such as PIC12672-10E/SM)

which controls the operation of the LED 26. A set of contacts 70 are provided for programming the microprocessor 68 during production. As an energy-saving feature, an angle sensitive switch 72 toggles (open and closes) as the firefighter moves his head up or down more than 10° from the horizontal position (as would occur during use). Each time such movement occurs, the switch signals the microprocessor, and keeps it awake. This arrangement allows for the unit to be in "sleep mode" when not in use, as long as the outside temperature remains below a certain threshold value $T_1$ as will be explained in greater detail below.

The logic of the microprocessor 68 is shown in simplified form FIG. 4. Initially, as shown in Statement A of the flow chart, the microprocessor 68 reads the temperature t as input by the thermistor 28. The system then moves on to Decision B which determines whether the temperature t is greater than a predetermined first threshold temperature $T_1$, which is recognized to be "safe", for instance 150° F. If it is determined that t is less than or equal to $T_1$, the LED stays off, as shown at Statement C. If it is determined that t is greater than $T_1$, the system moves on to Decision D, which determines whether the temperature t is greater than a predetermined second threshold temperature $T_2$, for instance 200° F. If $T_1<t<T_2$, then the LED goes on in the form of a solid yellow light, after first flashing yellow rapidly t5 times to get the wearer's attention, as shown at statement E. If $t>T_2$, then the system proceeds to Decision F, which determines whether the temperature t is greater than a predetermined third threshold temperature $T_3$., for instance 250° F. If $T_2<t<T_3$, then the yellow light begins to flash, as shown at Statement G. If $t>T_3$, then the system proceeds to Decision H, which determines whether the temperature is greater than a predetermined fourth threshold temperature $T_4$, for instance 300° F. If $T_3<t<T_4$, then the LED changes to a solid red color, after flashing 5 times rapidly in red, as shown at statement I. If $t>T_4$, the system proceeds to decision J, which determines whether the temperature is greater than a maximum allowable temperature $T_{MAX}$, for instance 500° F. If $T_4<t<T_{MAX}$, the red light begins to flash, as shown at statement K. If $t>T_{MAX}$, the LED begins to flash alternately red and yellow as shown at statement L. Since the thermistor and housing have a thermal time constant, the indicator reflects exposure to heat both in terms of intensity and length of time, as the human body does.

Figure 5:
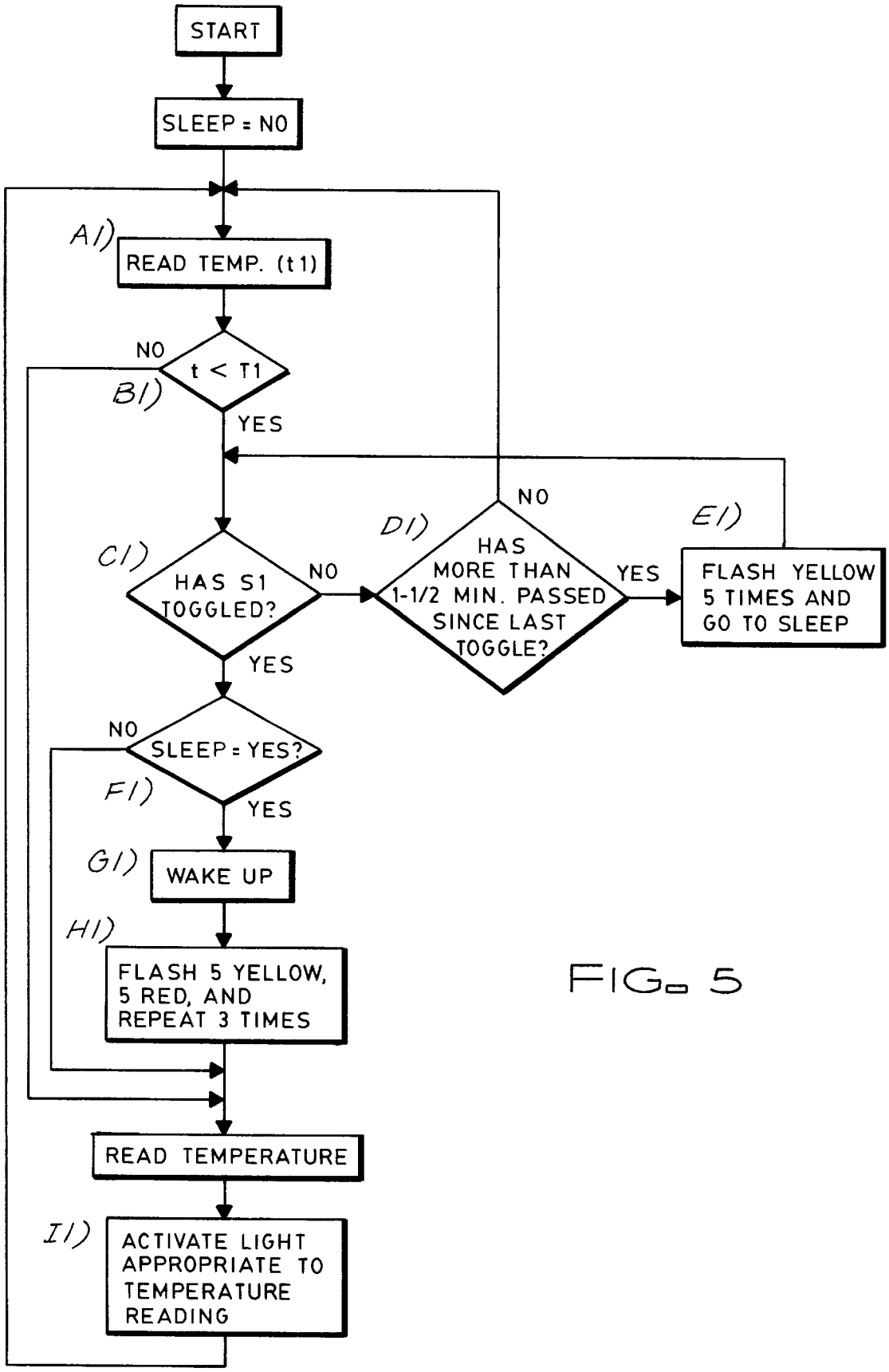
FIG. 5 is a flow chart depicting the logic of the unit's "Sleep" function.

FIG. 5 shows the logic for the power-saving or "Sleep" function of the unit 10. Initially, the variable "SLEEP" is set at "NO" ', as shown at statement A1. This indicates that the unit is in use, in its full-power, or "awake" mode. Next, as shown at decision B1, the microprocessor 68 reads the temperature t as determined by the thermistor 28. If t<T1, the microprocessor checks the angle-sensitive switch 72 to determine whether there has been any movement in the past 1.5 minutes, as shown at Decisions C1 and D1. If so, the unit 10 goes to sleep, as shown at Statement E1, and if not, it continues to check the temperature and movement at frequent intervals (approximately once per second). When the unit is asleep, any movement wakes it up, and the LED flashes in a predetermined pattern to notify the user that the unit is again in "awake" mode, as shown in Steps F1–H1, and then goes back to checking the temperature and movement at frequent intervals. While awake, if the unit determines that t>T1, it activates the LED to display a pattern appropriate to the temperature, as shown at Statement I1, and then goes back to checking the temperature at frequent intervals.

As an additional safety feature, in addition to performing the routines described above for checking and indicating the outside temperature, as well as for setting itself in "sleep" mode when not in use, the unit 10 may perform checks of all its components at regular intervals to determine whether they are operational. If any element is determined to be malfunctioning, the LED will flash alternating yellow and red "wigwag" pattern, which warns the user that the device is not operational.

Various modifications and variations to the embodiment herein chosen for purposes of illustration will readily occur to those skilled in the art. For instance, signaling means other than an LED could be incorporated into the equipment. Audible, rather than visible, signaling means could be used. One example of an audible signaling means is a beeper, which could be programmed to emit beeps at different frequencies depending on the temperature range. Another example would be a voice simulator which could actually read out the temperature at selected intervals. In addition, many arrangements other than the illustrated clamp could be used for securing the device to the firefighter's helmet. The device could even be integral with the helmet. In addition, the device need not be restricted to use with firefighter's helmets, but could also be adapted for use with hoods and other types of gear worn by hazardous duty personnel. To the extent that such modifications and variations do not depart from the spirit of the invention, they are intended to be included within the scope thereof.

Having fully described and disclosed the instant invention in such clear and concise terms as to enable one of ordinary skill in the art to understand and practice the same, the invention claimed is:

I claim as my invention:

1. A personal safety device for use in a high temperature environment, the device comprising:

a protective housing;

temperature sensing means mounted within the housing and communicating with the surrounding environment for measuring the temperature of the environment;

a light source mounted within the housing and detectable outside of the housing for emitting light at a variable flash rate;

control means mounted within said housing and coupled to said temperature sensing means and said indicating means for varying said flash rate in responses to changes in the environment as detected by the sensing means; and attachment means coupled to said housing for securing said housing to an article of clothing.

2. A personal safety device for use in a high temperature environment, the device comprising:

a protective housing;

an electrical power source contained within said housing;

electrical temperature sensing means electrically coupled to said electrical power source and mounted within the housing, said sensing means communicating with the surrounding environment to measure the temperature of the environment;

electrical light-emitting means electrically coupled to said power source and mounted within the housing, said light-emitting means producing a variable, visible signal dependent on said temperature;

electrical control means mounted within said housing and electrically coupled to said power source, said temperature sensing means, and said indicating means for varying said signal according to said temperature, said control means including comparator means for comparing the temperature of the environment as measured by the sensing means with a predetermined threshold temperature, activating means for activating said visible signal when the temperature of the environment exceeds the threshold temperature, detector means for sensing movement of the housing, and means for reducing the power consumption of the power source to induce a sleep mode when the temperature of the environment is below the threshold temperature and the detector means senses no movement within a predetermined time period; and attachment means coupled to said housing for securing said housing to an article of clothing.

3. The device according to claim 2, wherein the control means further includes means for signaling when the device changes to and from sleep mode.

4. The device according to claim 2, wherein the detector means comprises an angle-sensitive switch electrically coupled to the power source and the indicator means, disposed for movement between an open position and a closed position when the housing is moved beyond a predetermined angular position.

5. A personal safety device for monitoring ambient temperatures in an environment surrounding a firefighter wearing a helmet having a brim, the device comprising:

temperature sensing means communicating directly with said surrounding environment for sensing said ambient temperature;

indicating means for producing a variable signal dependent on said temperature;

control means coupled to said temperature sensing means and said indicating means for varying said signal according to said temperature;

positioning means for holding said temperature sensing means in spaced relationship to said helmet and locating said indicating means in a position clearly visible to the firefighter, said positioning means comprising a unitary protective housing surrounding said sensing means, said indicating means, and said control means; and attachment means coupled to said housing for detachably securing said device to said brim of said helmet.

6. The device according to claim 5, wherein the temperature sensing means, the indicating means, and the control means are electrical components electrically coupled to an electrical power source.

7. The device according to claim 6, wherein the electrical power source is a direct current power source.

8. The device according to claim 5, wherein:

said indicating means comprises light-emitting means for producing a visible signal; and said control means includes comparator means for comparing the temperature of the environment as measured by the sensing means with a predetermined threshold temperature, and activating means for activating said visible signal when the temperature of the environment exceeds the threshold temperature.

9. The device according to claim 8, wherein:

said light-emitting means comprises a dual-color light source for producing a first signal corresponding to light of a first color, and a second signal corresponding to light of a second color;

said comparator means further comprises means for comparing the temperature of the environment to a second threshold temperature higher than the threshold temperature; and said activating means further comprises means for changing the light emitted by the light source from said first color to said second color when the temperature of the environment exceeds the second threshold temperature.

10. The device according to claim 9, wherein:

said comparator means further comprises means for comparing the temperature of the environment to a maximum threshold temperature higher than said first and second threshold temperatures; and said control means further comprises means for producing alternating flashes of said first color and said second color when the temperature exceeds the maximum threshold temperature.

* * * * *